US010176795B2

(12) United States Patent
Christoph et al.

(10) Patent No.: US 10,176,795 B2
(45) Date of Patent: Jan. 8, 2019

(54) ACTIVE NOISE CONTROL BY ADAPTIVE NOISE FILTERING

(71) Applicant: HARMAN BECKER AUTOMOTIVE SYSTEMS GMBH, Karlsbad (DE)

(72) Inventors: Markus E. Christoph, Straubing (DE); Juergen Heinrich Zollner, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/380,319

(22) Filed: Dec. 15, 2016

(65) Prior Publication Data

US 2017/0178617 A1 Jun. 22, 2017

(30) Foreign Application Priority Data

Dec. 17, 2015 (EP) ..... 15200631

(51) Int. Cl.
*G10K 11/16* (2006.01)
*G10K 11/178* (2006.01)
*G10L 21/0208* (2013.01)

(52) U.S. Cl.
CPC .... *G10K 11/1786* (2013.01); *G10K 11/17853* (2018.01); *G10K 11/17883* (2018.01); *G10L 21/0208* (2013.01); *G10K 2210/12* (2013.01); *G10K 2210/1282* (2013.01); *G10K 2210/3025* (2013.01); *G10K 2210/3028* (2013.01); *G10K 2210/3055* (2013.01)

(58) Field of Classification Search
CPC ..... G10K 11/1786; G10K 11/1788; G10K 2210/1282; G10K 2210/3205; G10K 2210/3028; G10K 2210/2055
USPC ..... 381/71.1, 71.4, 86
See application file for complete search history.

(56) References Cited

U.S. PATENT DOCUMENTS

2010/0098263 A1* 4/2010 Pan ..... G10K 11/178 381/71.11
2011/0007907 A1* 1/2011 Park ..... G10K 11/178 381/71.8
2013/0083939 A1* 4/2013 Fellers ..... G10K 11/178 381/71.11

FOREIGN PATENT DOCUMENTS

EP 0560364 A1 9/1993

OTHER PUBLICATIONS

Kim et al., "Linear independence method for system identification/secondary path modeling for active control", J. Acoust. Soc. Am., 118 (3), Sep. 1, 2005, pp. 1452-1468.

(Continued)

*Primary Examiner* — Katherine A Faley
(74) *Attorney, Agent, or Firm* — Brooks Kushman P.C.

(57) ABSTRACT

The present invention relates to a method of noise reduction including the steps of filtering reference signals and representing noise by an adaptive filter comprising adaptive filter coefficients to obtain actuator driving signals, outputting the actuator driving signals by loudspeakers to obtain loudspeaker signals. The method further includes detecting the loudspeaker signals by microphones and filtering the reference signals by estimated transfer functions representing the transfer of the loudspeaker signals output by the loudspeakers to the microphones to obtain filtered reference signals. The method further includes updating the filter coefficients of the adaptive filter based on the filtered reference signals and based on the previously updated filter coefficients of the adaptive filter multiplied by leakage factors.

15 Claims, 4 Drawing Sheets

(56) References Cited

OTHER PUBLICATIONS

Akhtar et al., "Improving performance of FxLMS algorithm for active noise control of impulsive noise", Journal of Sound and Vibration, 327, 2009, pp. 647-656.
Hillis et al., "A comparison of two adaptive algorithms for the control of active engine mounts", Journal of Sound and Vibration, 286, 2005, pp. 37-54.
Extended European Search Report for Application No. 15200631.8, dated Jul. 4, 2016, 9 pages.
Kuo et al., "Active Noise Control: A Tutorial Review", Proceedings of the IEEE, vol. 87, No. 6, Jun. 1999, pp. 943-973.
Guldenschuh, "New Approaches for Active Noise Control Headphones", Jun. 2014, 188 pages.
Aboulnasr et al., "A Robust Variable Step-Size LMS-Type Algorithm: Analysis and Simulations", IEEE Transactions on Signal Processing, vol. 45, No. 3, Mar. 1997, pp. 631-639.

* cited by examiner

ACTIVE NOISE CONTROL BY ADAPTIVE NOISE FILTERING

CROSS-REFERENCE TO RELATED APPLICATIONS

This application claims priority to EP application Serial No. 15200631.8 filed Dec. 17, 2015, the disclosure of which is hereby incorporated in its entirety by reference herein.

TECHNICAL FIELD

The present invention relates to the art of reduction of noise in a listener environment. In particular, the present invention relates to the reduction of noise by adaptive filtering, for example, the reduction of noise in the passenger compartment of a vehicle.

BACKGROUND

Two-way speech communication of two parties mutually transmitting and receiving audio signals, in particular, speech signals, often suffers from deterioration of the quality of the audio signals by background noise. Background noise in noisy environments can severely affect the quality and intelligibility of voice conversation and can, in the worst case, lead to a complete breakdown of the communication.

A prominent example is hands-free voice communication in vehicles. Hands-free telephones provide comfortable and safe communication systems of particular use in motor vehicles. In the case of hands-free telephones, it is mandatory to suppress noise in order to guarantee the communication. The amplitudes and frequencies of the noise signals are temporally variable due to, for example, the speed of the vehicle and road noises. Moreover, noise heavily affects enjoying consumption of multimedia by a passenger in a vehicle, for example, an automobile, wherein a multimedia content is presented to a front/rear passenger by some front/rear seat entertainment system providing high-fidelity audio presentation using a plurality of loudspeakers arranged within the vehicle passenger compartment.

Herein, noise (or "disturbing sound"), in contrast to a useful sound signal, is considered a sound that is not intended to be perceived by a receiver (for example, a listener positioned in a vehicle compartment). With respect to motor vehicles noise can include sound signals generated by mechanical vibrations of an engine, fans or vehicle components mechanically coupled to the engine or fans and the wind as well as road noise as sound generated by the tires.

Noise within a listening environment can be suppressed using a variety of techniques. For example, noise may be reduced or suppressed by damping the noise signal at the noise source. The noise may also be suppressed by inhibiting or damping transmission and/or radiation of the noise. In many applications, however, these noise suppression techniques do not reduce noise levels in the listening environment below an acceptable limit. This is especially true for noise signals in the bass frequency range. Therefore, it has been suggested to suppress noise by means of destructive interference, i.e., by superposing the noise signal with a compensation signal. Typically, such noise suppression systems are referred to as "active noise cancelling" or "active noise control" (ANC) systems. The compensation signal has amplitude and frequency components that are equal to those of the noise signal; however, it is phase shifted by 180°. As a result, the compensation sound signal destructively interferes with the noise signal, thereby eliminating or damping the noise signal at least at certain positions within the listening environment.

Typically, active noise control systems use digital signal processing and digital filtering techniques. For example, a noise sensor such as, for example, a microphone or a non-acoustic sensor may be used to obtain an electrical reference signal representing the disturbing noise signal generated by a noise source. This reference signal is fed to an adaptive filter that outputs an actuator driving signal. The actuator driving signal is then supplied to an acoustic actuator (for example, a loudspeaker) that generates a compensation sound field, which has an opposite phase to the noise signal, within a portion of the listening environment. This compensation field thus damps or eliminates the noise signal within this portion of the listening environment. A residual noise signal may be measured using a microphone. The microphone provides an "error signal" to the adaptive filter, where filter coefficients of the adaptive filter are modified such that a norm (for example, power) of the error signal is reduced.

The adaptive filter may use known digital signal processing methods, such as an enhanced least mean squares (LMS) method, to reduce the error signal, or more specifically, the power of the error signal. Examples of such enhanced LMS method include a filtered-x-LMS (FXLMS, x denotes the input reference signal) algorithm or modified versions thereof, or a filtered-error-LMS (FELMS) algorithm.

A model that represents an acoustic transmission path from the acoustic actuator (i.e., the loudspeaker) to the error signal sensor (i.e., the microphone) is used when applying the FXLMS (or any related) algorithm. This acoustic transmission path from the loudspeaker to the microphone is usually referred to as a "secondary path" of the ANC system. In contrast, the acoustic transmission path from the noise source to the microphone is usually referred to as a "primary path" of the ANC system. The estimation of the transmission function (i.e., the frequency response) of the secondary path of the ANC system has a considerable impact on the convergence behavior and stability of an adaptive filter that uses the FXLMS algorithm. Particularly, a varying secondary path transmission function heavily affects the overall performance of the active noise control system. In order to improve the stability normalization of the reference signal has been employed thereby arriving at a normalized filtered-x-LMS (NFXLMS).

However, despite the engineering progress of the recent years there are still problems with respect to stability and overall processor load and speed involved in ANC. Therefore, it is an object of the present application to enhance stability and speed of adaptive filtering comprised in ANC.

SUMMARY

The following presents a simplified summary of the disclosure in order to provide a basic understanding of some aspects of the disclosure. This summary is not an exhaustive overview of the disclosure. It is not intended to identify key or critical elements of the disclosure or to delineate the scope of the disclosure. Its sole purpose is to present some concepts in a simplified form as a prelude to the more detailed description that is discussed later.

In view of the above-mentioned problems, in the present invention it is provided a method of noise reduction, comprising the steps of:

filtering reference signals $x_k[n]$, k=1, . . . , K, K being an integer denoting the number of reference signals (channels)

in the time domain, representing noise by an adaptive filter comprising adaptive filter coefficients to obtain actuator (loudspeaker) driving signals $y_m[n]$, m=1, . . . , M, M being an integer;

outputting the actuator driving signals $y_m[n]$ by M loudspeakers to obtain loudspeaker (output) signals (M denoting the number or loudspeakers (loudspeaker output channels in the time domain));

detecting the loudspeaker signals by L microphones, L being an integer (denoting the number of microphones and error channels; see below);

filtering the reference signals by estimated transfer functions representing the transfer of the loudspeaker signals output by the M loudspeakers to the L microphones to obtain filtered reference signals;

updating the filter coefficients of the adaptive filter based on the filtered reference signals and previously updated filter coefficients of the adaptive filter multiplied by leakage factors.

The method may comprise transforming the reference signals $x_k[n]$ into the frequency domain to obtain reference signals in the frequency domain $X_k[k]$ and the filtering of the reference signals by estimated transfer functions may be performed in the frequency domain.

For example, a noise sensor such as, for example, a microphone or a non-acoustic sensor may be used to obtain the reference signals. Whereas in the art, updating is performed based on previously updated filter coefficients (at a time n) and transfer functions representing the transfer of the loudspeaker signals output by the M loudspeakers to the L microphones to obtain updated filter coefficients (at a time n+1) a leakage matrix consisting of leakage factors is employed according to an embodiment of the invention. By a leakage matrix, pre-determined ones of the previously updated filter coefficients can be modified, for example, set to zero by multiplication with zero-valued leakage factors either in the time or frequency domain (in terms of processor load processing in the frequency domain may be preferred). For example, pre-determined ones of the previously updated filter coefficients can be multiplied by leakage factors in the range of 0.5 to 0.01 or 0.0001 or 0. Thereby, the stability of the adaptation algorithm for updating the filter coefficients of the adaptive filter can be significantly improved (see also detailed description below). The method according to this embodiment as well as the methods according to the embodiments described below can be applied in the context active noise cancellation, particular, road noise cancellation, in vehicle compartments. In-vehicle communication/entertainment in automobiles, for example, can be improved by implementation of the methods in in-vehicle communication/entertainment systems.

It has to be noted that the introduction of leakage factors may slow down the convergence speed of the adaptation procedure for updating the filter coefficients. Depending on the actual application this may be considered acceptable given the advantage of the increased stability. On the other hand, the convergence speed may be increased by the introduction of non-constant adaptation sizes. For example, according to the Filtered X Least Mean Square (FXLMS) algorithm of the art updating of coefficients w of a matrix is basically achieved according to $w(n+1)=w(n)+\mu\, e(n)\, z(n)$, with e(n) denoting a residual error and z(n) denoting a reference signal filtered through a secondary path model and μ being the constant adaptation size governing speed and stability of the convergence process. Contrary, according to an embodiment an adaptation step size of the updating of the filter coefficients of the adaptive filter is not constant, in particular, frequency dependent. In fact, the adaptation step sizes may be individually fine-tuned according to the actual application thereby increasing the overall convergence of the filter coefficient adaptation.

It is noted that the approaches of the introduction of the leakage factors and the introduction of non-constant adaptation step sizes may be combined or may be alternatively implemented independently from each other. Thus, it is also provided herein a method of noise reduction, comprising the steps of:

filtering reference signals $x_k[n]$, k=1, . . . , K, K being an integer denoting the number of reference signals (channels) in the time domain, representing noise by an adaptive filter comprising adaptive filter coefficients to obtain actuator (loudspeaker) driving signals $y_m[n]$, m=1, . . . , M, M being an integer;

outputting the actuator driving signals $y_m[n]$ by M loudspeakers to obtain loudspeaker (output) signals (M denoting the number or loudspeakers (loudspeaker output channels in the time domain));

detecting the loudspeaker signals by L microphones, L being an integer (denoting the number of microphones and error channels; see below);

filtering the reference signals by estimated transfer functions representing the transfer of the loudspeaker signals output by the M loudspeakers to the L microphones to obtain filtered reference signals; and updating the filter coefficients of the adaptive filter based on the filtered reference signals; and previously updated filter coefficients of the adaptive filter;

and wherein the updating is performed using non-constant, in particular, frequency-dependent, adaptation step sizes.

The method may comprise transforming the reference signals $x_k[n]$ into the frequency domain to obtain reference signals in the frequency domain $X_k[k]$ and the filtering of the reference signals by estimated transfer functions may be performed in the frequency domain.

In any case, the above-described embodiments may be supplemented by determining at least one control parameter of a vehicle, for example, selected from a group consisting of the speed of the vehicle, a pressure of a tire of the vehicle, information indicating that the vehicle is off-road, information on a driving mode of the vehicle, information on a closed/open state of doors and/or the trunk and/or windows and/or the roof of the vehicle and an audio level adjusted for an audio device of the vehicle and controlling the adaptation step sizes depending on the determined at least one parameter of the vehicle. In particular, the adaptation step sizes may depend on time-dependent control parameters. Depending on different applications and/or driving situations different sets of adaptation step sizes may be used in the process of updating the filter coefficients of the adaptive filter. Thus, the updating process can be dynamically adjusted to the current circumstances, for example, the current driving situation in the context of automotive applications.

In all of the above-described examples the updating of the filter coefficients of the adaptive filter may at least partly be performed in the frequency domain in order to save processing time. In this case, a matrix of the Fourier transformed previously updated filter coefficients can be multiplied by a matrix of leakage coefficients (given in the frequency domain). As known in the art, signal representations in the time domain may be transformed into the frequency domain by (Fast) Fourier transforms and signal representations in the frequency domain may be transformed into the time domain by Inverse (Fast) Fourier transforms.

According to a particular embodiment, the updating of the filter coefficients of the adaptive filter is performed according to:

$$w_{k,m}[n+1]=\mathrm{IFFT}(W^{old}_{k,m}[k]V_{k,m}[k]-C_{k,m}[k]),$$

wherein $w_{k,m}[n+1]$ are the filter coefficients of the adaptive filter updated at time step n+1, IFFT is an Inverse Fast Fourier Transform, and $W^{old}_{k,m}[k]$ denotes the filter coefficients $w_{k,m}[n]$ of the previous time step n transformed into the frequency domain, $V_{k,m}[k]$ a leakage matrix comprising the frequency dependent leakage factors and wherein $C_{k,m}[k]$ is the product of the adaptation step sizes ($\mu$, $\mu_{k,m}[k]$ or $\mu^{SP}_{k,m}[k]$; see below) used for the updating of the filter coefficients and a summed cross spectrum $$SCS_{k,m}[k]=\sum_{l=1}^{L} conj\left(X_k[k]\hat{S}_{m,l}[k]\right)E_l[k]$$

where conj denotes the conjugate operation (matrix), $X_k[k]$ are the reference signals transformed into the frequency domain, $\hat{S}_{m,l}[k]$ is a matrix of the estimated transfer functions (of the secondary path, i.e., representing the transfer of the loudspeaker signals output by the M loudspeakers to the L microphones) in the frequency domain and $E_l[k]$, with l=1, . . . , L, are error signals in the frequency domain obtained by the L microphones. As usual the error signals measure the success of noise cancellation and have to be minimized by adaptation of the adaptive filter.

In principle, when using the concrete algorithm $w_{k,m}[n+1]=\mathrm{IFFT}(W^{old}_{k,m}[k]\ V_{k,m}[k]-C_{k,m}[k])$, the adaptation step sizes can be given by a global constant adaptation step size $\mu$ used for all k, m or a frequency-dependent matrix $\mu_{k,m}[k]$ comprising values of the adaptation step sizes or a time-dependent and frequency-dependent matrix $\mu^{SP}_{k,m}[k]$ comprising values of the adaptation step sizes. Dynamic control parameters may be determined and the adaptation step sizes may be given by a time-dependent and frequency-dependent matrix $\mu^{SP}_{k,m}[k]$ comprising values of the adaptation step sizes that depend on the determined dynamic control parameters. The dynamic control parameters may be selected from a group consisting of a current vehicle speed, tire pressure, vehicle on- or off-road status, dynamic driving modes, door/rooftop/trunk open/close states, windows/sunroof open/close states or an infotainment/entertainment operation/audio level.

Furthermore, it is provided herein a computer program product comprising one or more computer readable media having computer-executable instructions for performing the steps of the method according to one of the above-described embodiments of the method of noise reduction when run on a computer.

In order to address the above-mentioned object it is also provided a noise reduction apparatus, comprising:

a first adaptive filter comprising filter coefficients configured for adaptively filtering reference signals $x_k[n]$, k=1, . . . , K, K being an integer, representing noise to obtain a actuator (loudspeaker) driving signals $y_m[n]$;

M loudspeakers configured for outputting the actuator driving signals $y_m[n]$, m=1, . . . , M, M being an integer, to obtain loudspeaker signals;

microphones configured for detecting the loudspeaker signals;

a second filter configured for filtering the reference signals by estimated transfer functions representing the transfer of the loudspeaker signals output by the M loudspeakers to the microphones to obtain filtered reference signals;

an adaptation unit configured for updating the filter coefficients of the adaptive filter based on the filtered reference signals and previously updated filter coefficients of the adaptive filter including multiplying at least some of the values of the previously updated filter coefficients by leakage factors.

The noise reduction apparatus may be configured to perform the steps of any of the above-described embodiments of the method of noise reduction. Particularly, it is provided a noise reduction apparatus, comprising:

a first adaptive filter comprising filter coefficients configured for adaptively filtering reference signals $x_k[n]$, k=1, . . . , K, K being an integer, representing noise to obtain a actuator driving signals $y_m[n]$;

M loudspeakers configured for outputting the actuator driving signals $y_m[n]$, m=1, . . . , M, M being an integer, to obtain loudspeaker signals;

microphones configured for detecting the loudspeaker signals;

a second filter configured for filtering the reference signals by estimated transfer functions representing the transfer of the loudspeaker signals output by the M loudspeakers to the microphones to obtain filtered reference signals; and an adaptation unit configured for updating the filter coefficients of the adaptive filter based on the filtered reference signals and previously updated filter coefficients of the adaptive filter and non-constant (for example, frequency-dependent) adaptation step sizes.

Examples of the herein provide a signal processor that can be advantageously used in a variety of electronic communication devices. In particular, it is provided an Active Noise Control system, in particular, an Active Noise Control system, comprising the noise reduction apparatus as described above.

BRIEF DESCRIPTION OF THE DRAWINGS

Additional features and advantages of the present invention will be described with reference to the drawings. In the description, reference is made to the accompanying figures that are meant to illustrate preferred embodiments of the invention. It is understood that such embodiments do not represent the full scope of the invention.

DETAILED DESCRIPTION

Figure 1:
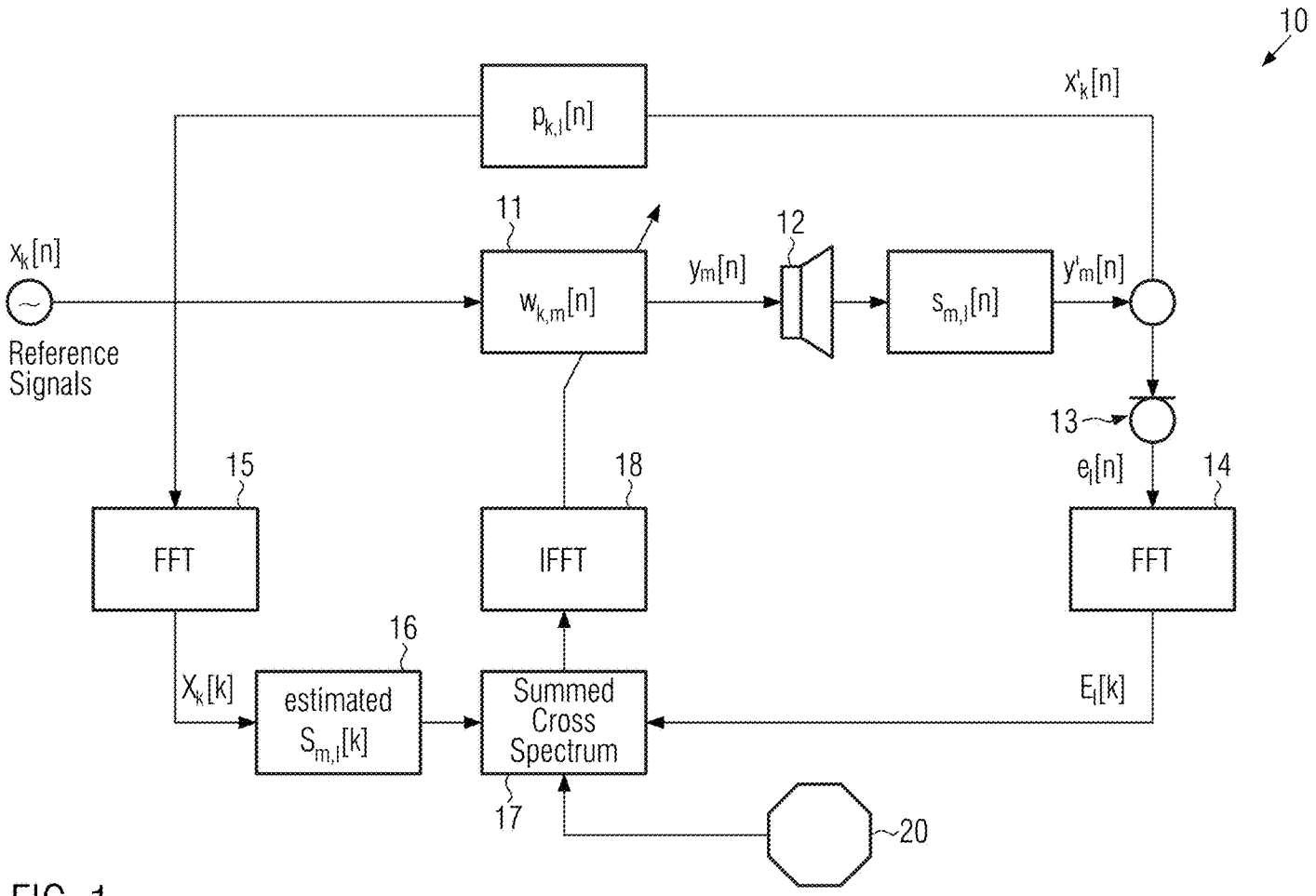
FIG. 1 illustrates a multichannel ANC device according to an example of the present invention.

While the present disclosure is described with reference to the examples as illustrated in the following detailed description as well as in the drawings, it should be understood that the following detailed description as well as the drawings are not intended to limit the subject matter to the particular illustrative embodiments disclosed, but rather the described illustrative embodiments merely exemplify the various aspects, the scope of which is defined by the appended claims.

Figure 2:
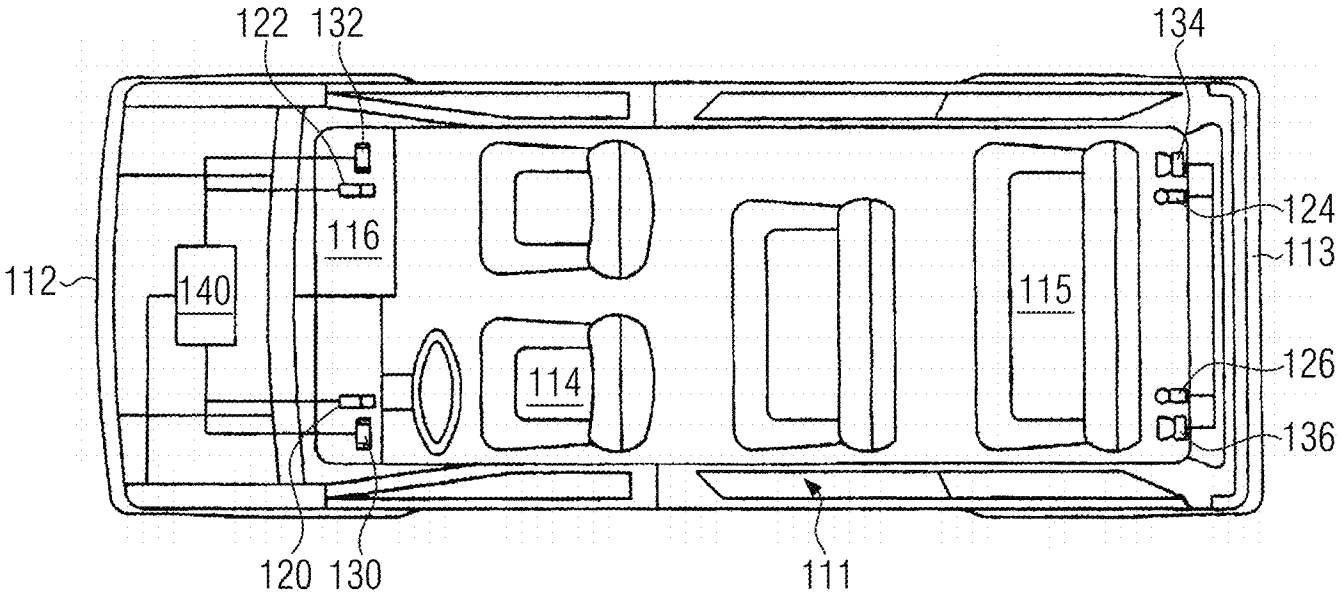
FIG. 2 illustrates an in-vehicle communication system wherein an ANC system according to the present invention can be integrated.

The present invention relates to active noise cancellation, in particular, in automotive applications. For example, methods and an apparatus are provided that are suitable for the reduction of noise in vehicle compartments wherein the noise can be road noise. FIG. 1 illustrates an exemplary multichannel ANC system 10 in which a noise reduction procedure according to the present invention can be realized. The multichannel ANC system 10 may be particularly suitable for automotive application directed to road noise cancellation (RNC). For example, the ANC system 10 may be integrated in an in-vehicle communication system as illustrated in FIG. 2.

A vehicle communication system may be installed in a vehicle passenger compartment 111 having a front end 112 and a rear end 113. A front seat 114 provides seating for a driver, and a rear seat 115 provides seating for the rear passengers. For example, four microphones 120-126 are located adjacent to four loudspeakers 130-136 in the vehicle passenger compartment 111. The first microphone 120 and the second microphone 122 are located at the front end 112 of the vehicle. A third microphone 124 and a fourth microphone 126 are located at the rear end 113 of the vehicle. First and second loudspeakers 130 and 132 are located adjacent to the first and second microphones 120 and 122 and third and fourth loudspeakers 134 and 136 are located adjacent to the third and fourth microphones 124 and 126. The loudspeakers 130-136 may be used by an audio entertainment system. Input signals from the microphones 120-126 are provided to a signal processing circuit 140 which interprets the signals and provides output signals to the loudspeakers 130-136. The signal processing circuit 140 can be located behind a vehicle dashboard 116, for example.

In the following, the ANC system 10 of FIG. 1 will be described in detail. In accordance with the common notation, in the following description, by n and k the $n^{th}$ sample in the time domain and the $k^{th}$ bin in the frequency domain are denoted, respectively. Multichannel reference signals $x_k[n]$ are provided within k=1, K reference channels in the time domain. The reference signal represents a disturbing noise that is generated by some noise source and should be suppressed in the ANC system 10.

The multichannel reference signals $x_k[n]$ are fed to an adaptive filter 11, for example, a finite impulse response (FIR) filter. The loudspeaker driving signals (compensation signals) $y_m[n]$ are supplied to loudspeakers 12 that output compensation sound fields with opposite phase as compared to the reference signals $x_k[n]$ within at least a portion of a listener environment, for example, a vehicle compartment. The index in denotes the loudspeaker output channels (m=1, . . . , M, M being the number of the loudspeakers 12). Residual noise signals are measured by microphones 13. The microphones 13 provide error signals $e_l[n]$ where l=1, . . . , L, L being the number of the microphones 13). In principle, the adaptive filter coefficients $w_{k,m}[n]$ of the adaptive filter 11 are to be adjusted (updated) such that a norm (for example, the power) of the error signals is reduced (minimized). The signals detected by the microphones 13 results from the combination of the multichannel reference signals $x_k[n]$ after being modified according to the transfer functions $p_{k,l}[n]$ of the acoustic transmission path of the listener environment from the noise source to the microphones 13 (primary path of the ANC system 10) and the loudspeaker output signals modified according to the transfer functions $s_{m,l}[n]$ of the acoustic transmission path of the listener environment from the loudspeakers 12 to the microphones 13 (secondary path of the ANC system 10). The loudspeaker signals as detected by the microphones 13, i.e., after having traveled the acoustic transmission path from the loudspeakers 12 to the microphones 13 are denoted by $y'_m[n]$. The multichannel reference signals modified according to the transfer functions $p_{k,l}[n]$ of the acoustic transmission path of the listener environment from the noise source to the microphones 13 are denoted by $x'_k[n]$. The microphones 13 are installed in the listener environment and the error signals $e_l[n]$ output by the microphones 13 measure the difference between $y'_m[n]$ and $x'_k[n]$. A model that represents the secondary path has to be used when applying an appropriate algorithm for adjusting (updating) the adaptive filter coefficients $w_{k,m}[n]$ of the adaptive filter 11 in order to minimize the error signals $e_l[n]$. The signal power of the error signals $e_l[n]$ may be regarded as a quality measure for the noise cancellation obtained by ANC system 10.

According to the example illustrated in FIG. 1 the updating branch operates in the frequency domain in order to accelerate the processing. The error signals $e_l[n]$ are Fourier transformed, for example, by a Fast Fourier Transform 14, to obtain error signals in the frequency domain $E_l[k]$. The multichannel reference signals $x_k[n]$ are Fourier transformed, for example, by a Fast Fourier Transform 15, to obtain multichannel reference signals $X_k[k]$ in the frequency domain. The reference signals $X_k[k]$ in the frequency domain are input in an estimated block 16 in order to be filtered by estimated secondary paths, i.e., the matrix of estimated transfer functions $\hat{S}_{m,l}[k]$ in the frequency domain. The matrix of estimated transfer functions $\hat{S}_{m,l}[k]$ in the frequency domain is used for updating the adaptive filter coefficients $w_{k,m}[n]$ of the adaptive filter 11. According to the shown example, the reference signals $X_k[k]$ in the frequency domain filtered by the matrix of estimated transfer functions $\hat{S}_{m,l}[k]$ and the error signals in the frequency domain $E_l[k]$ are input in a processor 17. The processor 17 is configured for calculating the summed cross spectrum $$SCS_{k,m}[k] = \sum_{l=1}^{L} conj(X_k[k]\hat{S}_{m,1}[k])E_1[k]$$

where conj denotes the conjugate operation (matrix). Moreover, the processor 17 calculates the updated filter coefficients of the adaptive filter 11. The processor 17 reads data from a memory 20 used for the updating process.

According to an embodiment, the processor 17 reads a leakage matrix $V_{k,m}[k]$ comprising frequency dependent leakage factors from the memory 20. Alternatively or additionally the processor 17 reads a matrix of frequency dependent adaptation step sizes $\mu_{k,m}[k]$ from the memory 20. In the following, examples of the updating algorithm according to the invention will be described in detail. After adaptation of the filter coefficients in the frequency domain by the processor 17 the adapted filter coefficients are input in an Inverse Fast Fourier Transform 18 to provide the adaptive filter 11 with the adapted filter coefficients in the time domain.

In principle, the summed cross spectrum $SCS_{k,m}[k]$ could be used for updating the filter coefficients $w_{k,m}[n]$ of the adaptive filter 11 simply according to:

$$w_{k,m}[n+1]=w_{k,m}[n]-\mu IFFT(SCS_{k,m}[k]), \quad \text{(Equation 1)}$$

where μ is the constant adaptation step size and IFFT denotes an Inverse Fast Fourier Transform operation. This procedure is known to be applied in the Filtered X Least Means Square (FXLMS) algorithm of the art.

However, stability of the FXLMS algorithm is heavily affected by the accuracy of the estimation of the secondary path of the ANC system 10 and the level of disturbances in the multichannel reference signals $x_k[n]$. Particularly, time dependent variations of the secondary path and the disturbances in the multichannel reference signals $x_k[n]$ cause instabilities of the FXLMS algorithms of the art. According to an embodiment of the present invention stability of the updating procedure is significantly improved by a leakage matrix used in an updating time step n+1 to modify values of filter coefficients obtained for a previous time step n.

Figure 3:
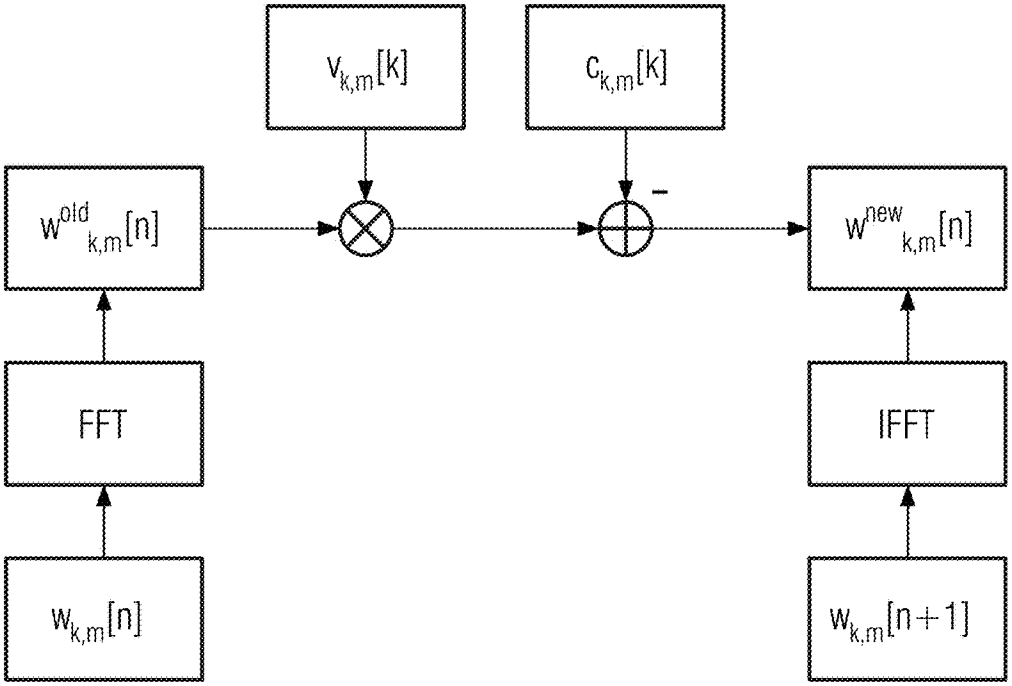
FIG. 3 illustrates employment of a leakage matrix in an updating algorithm for adjusting filter coefficients of an adaptive filter of an ANC system according to an example of the present invention.

An example of the employment of a leakage matrix is illustrated in FIG. 3. The procedure shown in FIG. 3 can be implemented in the adaptation unit 19 of the ANC system 10, for example. The procedure can be performed to modify the algorithm according to Equation 1. Instead of using the previously updated filter coefficients $w_{k,m}[n]$ as they were obtained these filter coefficients are multiplied by leakage factors, for example, in the frequency domain. Processing in the frequency domain rather than in the time domain may be advantageous with respect to increased processing speed (expensive convolution operations can be avoided).

As shown in FIG. 3 filter coefficients $w_{k,m}[n]$ of the previous time step n (old filter coefficients) are transformed by a Fast Fourier Transform operation to obtain a representation of these filter coefficients in the frequency domain $W^{old}_{k,m}[k]$. The matrix of the old filter coefficients is multiplied by a leakage matrix $V_{k,m}[k]$. The leakage matrix consists of frequency dependent leakage factors that are tunable for each individual element of the matrix of filter coefficients. For example, the leakage matrix may consist of the values 0 and 1 only. In this case, multiplication by the leakage matrix implies setting the corresponding filter coefficients to zero. Leakage factors may lie in the range of 0.5 or 1 to 0.01 or 0.0001 or 0. Spectral components, which are supposed to be problematic to handle, could be tagged and individually tuned with a different leakage value, and therefore undesired prominent w-filter impacts could vanish faster, while others could sustain longer (increase stability). Moreover, limitation of the upper spectrum boundary of the leakage helps to increase stability against temporal changes of the secondary path of the ANC system 10.

As shown in FIG. 3 in a next step in order to obtain the updated (new) matrix of filter coefficients in the frequency domain $W^{new}_{k,m}[k]$ a matrix $C_{k,m}[k]$ is subtracted. This matrix can be identical with the summed cross spectrum multiplied by the adaptation step size, i.e., $C_{k,m}[k]=\mu\, SCS_{k,m}[k]$. However, it might be preferred to use a normalized version $\overline{SCS}_{k,m}[k]$ of the summed cross spectrum $SCS_{k,m}[k]$, i.e., $C_{k,m}[k]=\mu\, \overline{SCS}_{k,m}[k]$. For example, a suitable normalization of $SCS_{k,m}[k]$ may be given by $\overline{SCS}_{k,m}[k]=SCS_{k,m}[k]/\sqrt{X_k[k]\mathrm{conj}(X_k[k])}$. Moreover, instead of a global constant adaptation step size a matrix of frequency dependent adaptation step sizes may be used (see description below). As shown in FIG. 3 after an Inverse Fast Fourier Transform operation the updated filter coefficients $w_{k,m}[n+1]$ in the time domain are obtained. In mathematical notation the above-described updating algorithm can be written as $$w_{k,m}[n+1]=\mathrm{IFFT}(W^{old}_{k,m}[k]V_{k,m}[k]-C_{k,m}[k]), \qquad \text{(Equation 2)}$$

where again IFFT denotes an Inverse Fast Fourier Transform operation.

Whereas employment of the leakage matrix $V_{k,m}[k]$ increase stability, it may reduce convergence speed. According to another embodiment, that might be combined with the embodiment related to the leakage matrix $V_{k,m}[k]$, convergence (adaptation, updating) speed can be enhanced by the employment of frequency dependent adaptation step sizes $\mu_{k,m}[k]$ instead of a global constant adaptation step size μ. In this an algorithm according to:

$$w_{k,m}[n+1]=w_{k,m}[n]-\mathrm{IFFT}(\mu_{k,m}[k]SCS_{k,m}[k]) \qquad \text{(Equation 3)}$$

or $$w_{k,m}[n+1]=w_{k,m}[n]-\mathrm{IFFT}(\mu_{k,m}[k]\overline{SCS}_{k,m}[k]) \qquad \text{(Equation 4)}$$

might be employed.

The adaptation step sizes $\mu_{k,m}[k]$ are shaped over all frequency bins for each filter matrix index 'm' and 'k' according to one particular pre-determined step size tuning set. In principle, it is possible to provide for a plurality of different step size tuning sets. In the automotive context, this might prove helpful in order to adapt to different vehicle variants and dynamic conditions as, for example, the vehicle body and suspension variant, tire pressure, type of tire, information about dynamic chassis/suspension control (e.g. sport/comfort mode), weather conditions, road conditions or other RNC resonance related control information. A particular one of tuning sets that might be stored in the memory 20, for example, in form of a look-up table, of the ANC system 10 can be selected (for example, by user input or automatically based on reception of accordingly designed control signals, based on the vehicle variants and/or dynamical conditions.

As compared to updating of the filter coefficients of the adaptive filter 11 based on a global constant adaptation step sizes μ employment of frequency dependent adaptation step sizes $\mu_{k,m}[k]$ is more expensive in terms of the processor load and memory demands. However, employment of frequency dependent adaptation step sizes $\mu_{k,m}[k]$ allows for improving the updating process significantly.

Instead of being restricted to one single global adaptation step size, the adaptation step size can be individually adjusted for a particular configuration of an in-vehicle communication system, for example, particular loudspeakers, accelerometers, external boundary conditions, etc. Moreover, the individually adjusted adaptation step sizes offer the flexibility to fine-tune each seat position in a vehicle, for example, by an individual weighting with respect to rumble and torus in order to increase the adaptation performance or with respect to individual frequency roll-off definitions in order to increase the adaptation stability. Beside resonances such a technique can also handle individual seat location constraints, because front and rear suspension, if mechanically decoupled, show decoupled noise impact on different seat positions within the vehicle compartment. Thereby, the system performance can be improved because the algorithm is more focused to cancel around the resonance frequencies and as such, the robustness of the adaptation algorithm will be increased since a disturbing noise that is not coherent to road noise will be ignored within tuned notches if the adaptation step size design is properly selected.

Additionally, the maximum frequency of operation can be defined individually by applying a roll-off in order to further enhance stability of the adaptation procedure. For example, the roll-off frequency can be set to 500 Hz. In particular, simulation studies have proven that when the roll-off frequency is beneficially set the system robustness against temporal changes in the secondary path can be significantly improved. Since road noise is showing dedicated resonances in rumble and torus inside the vehicle compartment the employment of frequency dependent adaptation step sizes $\mu_{k,m}[k]$ is particularly advantageous in the context of RNC.

According to different embodiments, the frequency dependent adaptation step sizes $\mu_{k,m}[k]$ may be static or may be adjusted in a time dependent manner ("on the-fly"), in the following time-dependent and frequency dependent adaptation step sizes depending on dynamic control parameters are denoted by $\mu^{SP}_{k,m}[k]$. In this case, the $\mu_{k,m}[k]$ may be functions of time-dependent control parameters. The time-dependent control parameters can be parameters that potentially have an impact to level and pitch of the RNC related chassis and body resonances. The time-dependent control parameters may be chosen from the group comprising the current vehicle speed, tire pressure, vehicle on- or off-road status, dynamic driving modes as, for example, sport and comfort modes, door/rooftop/trunk open/close states, windows/sunroof open/close states, an infotainment/entertainment operation/audio level, etc.

Although this approach based on time-dependent and frequency dependent adaptation step sizes $\mu^{SP}_{k,m}[k]$ is relatively expensive in terms of processor loads and requires a detailed understanding, for example, of the correlation between the speed and the corresponding resonances, it may nevertheless be implemented due to the enhancements that may be achieved. For example, it allows for dynamic scaling and pitching of the adaptation step sizes based on speed dependent resonances which increase performance of the adaptation algorithm. The approach allows for the reduction or limitation of the spectral bandwidth of the adaptation step size for vehicle events having an impact on secondary path modifications such as opening/closing of doors or other openings such as a sunroof. Thereby, the stability of the adaptation algorithm can be increased. Moreover, this approach allows for a temporary freeze of the filter adaptation due to special vehicle/user conditions. Such conditions may comprise a set high music volume beyond 70 dBSPL (A), for example, a vehicle in off-road status wherein many impulsive disturbances are to be expected, and a vehicle speed above some pre-defined limit wherein wind noise is the most dominant factor $\mu^{SP}_{k,m}[k]$ may prove useful.

If time-dependent adaptation step sizes $\mu^{SP}_{k,m}[k]$ are used it might be useful to set upper $\mu_{max}[k]$ and lower $\mu_{min}[k]$ boundary limits in order to guarantee stability of the adaptation algorithm, i.e., $\mu^{SP}_{k,m}[k] \in [\mu_{max}[k], \mu_{min}[k]]$.

Figure 4:
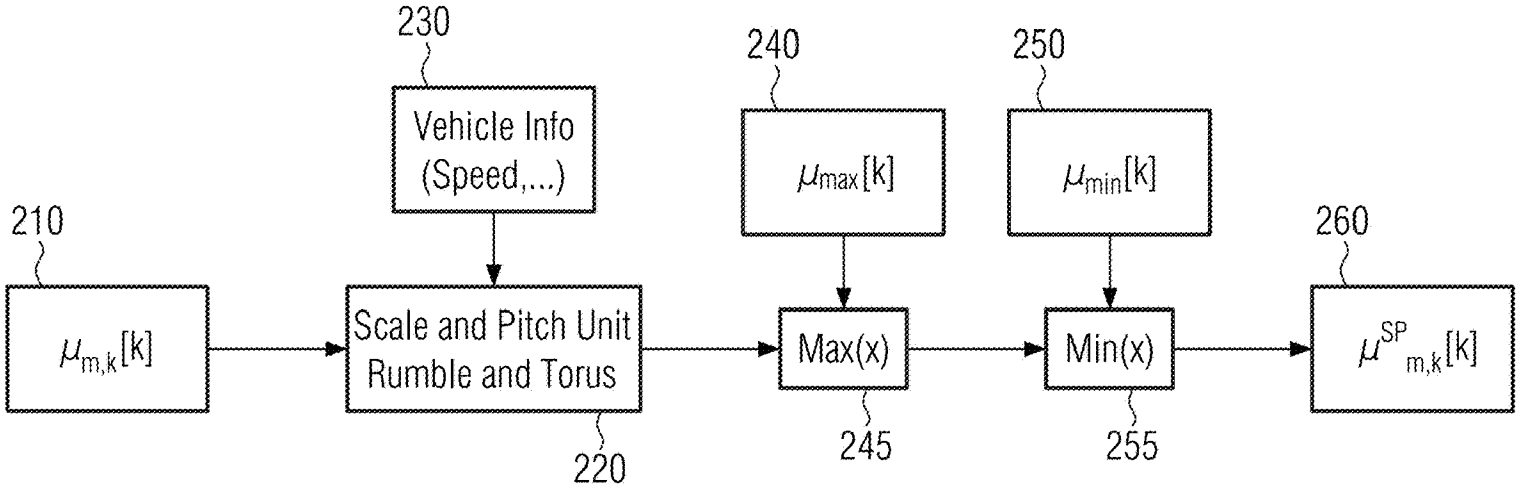
FIG. 4 illustrates a procedure of providing a set of adaptation sizes depending on time-dependent control parameters.

An example for implementation of time-dependent adaptation step sizes $\mu_{k,m}[k]$ being functions of time-dependent control parameters is illustrated in FIG. 4. A set of frequency-dependent adaptation sizes $\mu_{k,m}[k]$ 210 is input into a scale and pitch unit 220. The scale and pitch unit 220 receives dynamic control (vehicle) parameters 230, for example, the current vehicle speed, tire pressure, vehicle on- or off-road status, dynamic driving modes, door/rooftop/trunk open/close states, windows/sunroof open/close states or an infotainment/entertainment operation/audio level. Allowed upper and lower extreme values for the adaptation sizes are read, 240 and 250, and values of the adaptation sizes output by the scale and pitch unit 220 that exceed the read maximum are reduced to the read maximum value 245 and values that lie below the read minimum value are increased to that minimum value 255. After that correction a set of $\mu^{SP}_{k,m}[k]$ is output 260 and can be used in the adaptation algorithms according to Equations 3 and 4 described above (instead of $\mu$ and $\mu_{k,m}[k]$, respectively).

As already mentioned above the embodiments related to the leakage matrix and the frequency-dependent adaptation sizes $\mu_{k,m}[k]$ (as well as time-dependent and frequency dependent adaptation step sizes $\mu^{SP}_{k,m}[k]$) can be combined with each other. In particular, $C_{k,m}[k]=\mu\, SCS_{k,m}[k]$ in Equation 2 may be replaced by $C_{k,m}[k]=\mu_{k,m}[k]\, SCS_{k,m}[k]$ or $C_{k,m}[k]=\mu^{SP}_{k,m}[k]SCS_{k,m}[k]$, respectively.

All previously discussed embodiments are not intended as limitations but serve as examples illustrating features and advantages of the invention. It is to be understood that some or all of the above described features can also be combined in different ways.

What is claimed is:

1. A method for noise reduction comprising:

filtering multichannel reference signals representing noise by an adaptive filter including filter coefficients to obtain actuator driving signals;

outputting the actuator driving signals by one or more loudspeakers to obtain loudspeaker signals;

detecting the loudspeaker signals by one or more microphones;

filtering the multichannel reference signals by estimated transfer functions representing a transfer of the loudspeaker signals output by the one or more loudspeakers to the one or more microphones to obtain filtered multichannel reference signals;

updating the filter coefficients of the adaptive filter based on:

the filtered multichannel reference signals; and previously updated filter coefficients of the adaptive filter multiplied by leakage factors, and determining at least one control parameter of a vehicle, wherein the at least one control parameter is selected from a group consisting of a speed of the vehicle, a pressure of a tire of the vehicle, information indicating that the vehicle is off-road, information on a driving mode of the vehicle, information on a closed/open state of doors and/or a trunk and/or windows and/or a roof of the vehicle and an audio level adjusted for an audio device of the vehicle; and wherein:

adaptation step sizes of the updating of the filter coefficients of the adaptive filter are not constant; and the adaptation step sizes depend on the determined at least one control parameter of the vehicle.

2. The method of claim 1, wherein the adaptation step sizes depend on a time-dependent control parameter.

3. The method of claim 1, wherein the updating of the filter coefficients of the adaptive filter is at least partly performed in a frequency domain.

4. The method of claim 3, wherein a matrix of Fourier transformed previously updated filter coefficients is multiplied by a matrix of leakage coefficients.

5. The method of claim 4, wherein the updating of the filter coefficients of the adaptive filter is performed according to:

$$w_{k,m}[n+1]=\mathrm{IFFT}(W^{old}_{k,m}[k]V_{k,m}[k]-C_{k,m}[k]),$$

wherein $w_{k,m}[n+1]$ are the filter coefficients of the adaptive filter updated at a time step n+1, IFFT is an Inverse Fast Fourier Transform, $W^{old}_{k,m}[k]$ denotes the filter coefficients of a previous time step n transformed into the frequency domain, $V_{k,m}[k]$ a leakage matrix comprising the leakage factors that are frequency dependent and wherein $C_{k,m}[k]$ is a product of the adaptation step sizes used for the updating of the filter coefficients and a summed cross spectrum.

6. The method of claim 5, wherein the adaptation step sizes are given by: (a) a global constant adaptation step size or (b) a time-dependent and frequency-dependent adaptation step size, in particular, depending on dynamic control parameters or (c) a frequency-dependent matrix comprising values of the adaptation step sizes or (d) a time-dependent and frequency-dependent matrix including values of the adaptation step sizes.

7. The method of claim 6, further comprising determining dynamic control parameters and wherein the adaptation step sizes are given by a time-dependent and frequency-dependent matrix comprising values of the adaptation step sizes that depend on the determined dynamic control parameters.

8. The method of claim 7, wherein the dynamic control parameters are selected from a group consisting of a current vehicle speed, tire pressure, vehicle on- or off-road status, dynamic driving modes, door/rooftop/trunk open/close states, windows/sunroof open/close states and an infotainment/entertainment operation/audio level.

9. A noise reduction apparatus being configured to perform the method of claim 1.

10. A noise reduction apparatus comprising:

a first adaptive filter comprising filter coefficients and being configured to adaptively filter multichannel reference signals representing noise to obtain actuator driving signals;

at least one loudspeaker configured to output the actuator driving signals to obtain loudspeaker signals;

a plurality of microphones being configured to detect the loudspeaker signals;

a second filter configured to filter the multichannel reference signals by estimated transfer functions representing the transfer of the loudspeaker signals output by the at least one loudspeaker to the plurality of microphones to obtain filtered multichannel reference signals;

a memory to store data; and a processor configured to receive the data from the memory and to update the filter coefficients of the first adaptive filter based on the filtered multichannel reference signals and previously updated filter coefficients of the first adaptive filter including multiplying at least some values of the previously updated filter coefficients by leakage factors and to determine at least one control parameter of a vehicle, wherein the at least one control parameter is selected from a group consisting of a speed of the vehicle, a pressure of a tire of the vehicle, information indicating that the vehicle is off-road, information on a driving mode of the vehicle, information on a closed/open state of doors and/or a trunk and/or windows and/or a roof of the vehicle and an audio level adjusted for an audio device of the vehicle, wherein adaptation step sizes of the updating of the filter coefficients of the adaptive filter are not constant and depend on the determined at least one control parameter of the vehicle.

11. A vehicle active noise control system comprising the noise reduction apparatus of claim 10.

12. A method for noise reduction comprising:

filtering multichannel reference signals representing noise by an adaptive filter to obtain actuator driving signals;

outputting the actuator driving signals by one or more loudspeakers to obtain loudspeaker signals;

detecting the loudspeaker signals by one or more microphones;

filtering the multichannel reference signals by estimated transfer functions representing a transfer of the loudspeaker signals detected by the one or more microphones to obtain filtered multichannel reference signals;

updating filter coefficients of the adaptive filter based on the filtered multichannel reference signals and on previously updated filter coefficients of the adaptive filter multiplied by leakage factors, and determining at least one control parameter of a vehicle, wherein the at least one control parameter is selected from a group consisting of a speed of the vehicle, a pressure of a tire of the vehicle, information indicating that the vehicle is off-road, information on a driving mode of the vehicle, information on a closed/open state of doors and/or a trunk and/or windows and/or a roof of the vehicle and an audio level adjusted for an audio device of the vehicle; wherein:

adaptation step sizes of the updating of the filter coefficients of the adaptive filter are not constant, and the adaptation step sizes depend on the determined at least one control parameter of the vehicle.

13. The method of claim 12, wherein the adaptation step sizes depend on a time-dependent control parameter.

14. The method of claim 12, wherein the updating of the filter coefficients of the adaptive filter is at least partly performed in a frequency domain.

15. The method of claim 14, wherein a matrix of Fourier transformed previously updated filter coefficients is multiplied by a matrix of leakage coefficients.

* * * * *